US011859339B2

(12) United States Patent
Donar, Jr. et al.

(10) Patent No.: US 11,859,339 B2
(45) Date of Patent: Jan. 2, 2024

(54) WASHING MACHINE FLUID ADDITIVE DISPENSING SYSTEM

(71) Applicant: Haier US Appliance Solutions, Inc., Wilmington, DE (US)

(72) Inventors: Karlarrious Dawain Donar, Jr., Louisville, KY (US); Christopher Gene Vowels, Cox's Creek, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 209 days.

(21) Appl. No.: 17/395,810

(22) Filed: Aug. 6, 2021

(65) Prior Publication Data

US 2023/0040628 A1 Feb. 9, 2023

(51) Int. Cl.

| | |
|---|---|
| ***D06F 39/02*** | (2006.01) |
| ***D06F 23/04*** | (2006.01) |
| ***D06F 39/12*** | (2006.01) |

(52) U.S. Cl.

CPC ..... *D06F 39/022* (2013.01); *D06F 23/04* (2013.01); *D06F 39/028* (2013.01); *D06F 39/12* (2013.01)

(58) Field of Classification Search

CPC ..... D06F 39/022; D06F 23/04; D06F 39/02; D06F 39/028; D06F 39/088; D06F 33/37; D06F 2105/42; D06F 39/08; A47L 15/44

USPC ..... 68/12.18

See application file for complete search history.

(56) References Cited

U.S. PATENT DOCUMENTS

| | | | | |
|---|---|---|---|---|
| 9,885,139 | B1 * | 2/2018 | Leibman | D06F 39/02 |
| 10,435,834 | B2 | 10/2019 | Leibman | |
| 2015/0337480 | A1 * | 11/2015 | Lee | D06F 39/028 68/17 R |
| 2017/0327991 | A1 * | 11/2017 | Leibman | D06F 39/028 |
| 2020/0216998 | A1 | 7/2020 | Kopf-Moore | |
| 2020/0232149 | A1 * | 7/2020 | Ko | D06F 37/30 |

FOREIGN PATENT DOCUMENTS

| | | | |
|---|---|---|---|
| CN | 104195792 | A | 12/2014 |
| WO | WO2020208898 | A1 | 10/2020 |

* cited by examiner

*Primary Examiner* — David G Cormier
*Assistant Examiner* — Thomas Bucci
(74) *Attorney, Agent, or Firm* — Dority & Manning, P.A.

(57) ABSTRACT

A washing machine appliance defines a mutually perpendicular vertical direction, lateral direction, and transverse direction. The washing machine appliance includes a cabinet and a top cover. A wash tub is mounted within the cabinet and a wash basket is mounted rotatably within the wash tub. The wash basket is accessible through an opening in the top cover. A bulk tank is mounted inside the top cover. The washing machine appliance further includes a dispensing pump spaced apart from the bulk tank and in fluid communication with the bulk tank. The dispensing pump is operable to draw a liquid additive from the bulk tank. The washing machine appliance also includes a dispenser box downstream of the dispensing pump and upstream of the wash tub.

15 Claims, 11 Drawing Sheets

WASHING MACHINE FLUID ADDITIVE DISPENSING SYSTEM

FIELD OF THE INVENTION

The present subject matter relates generally to washing machine appliances and more particularly to washing machine appliances with fluid additive bulk storage and dispensing features.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

To introduce fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top cover of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

Some washing machine appliances also include features such as a reservoir for storing fluid additives over time and dispensing certain amounts of the fluid additives during operation of the appliance. For example, the reservoir may be sized to store a volume of additives suitable for use across multiple loads of laundry, which provides additional convenience to users in that the additives do not need to be manually added each time the washing machine appliance is run. However, existing systems are limited in the volume that can be provided in the reservoir without limiting space for other components or undesirably increasing the overall bulk of the washing machine appliance.

Accordingly, a washing machine appliance with improved features for storing and dispensing volumes of fluid additive for multiple operations would be useful.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided. The washing machine appliance defines a vertical direction, a lateral direction, and a transverse direction. The vertical, lateral, and transverse directions are mutually perpendicular. The washing machine appliance includes a cabinet extending along the transverse direction from a rear panel to a front panel, along the lateral direction from a left side panel to a right side panel, and along the vertical direction from a bottom end to a top end. A top cover has an opening defined in and through the top cover. The top cover is mounted to the cabinet at the top end of the cabinet. A wash tub is mounted within the cabinet below the top cover and is configured for containing fluid during operation of the washing machine appliance. A wash basket is rotatably mounted within the wash tub such that the wash basket is aligned with and accessible through the opening in the top cover. The washing machine appliance also includes a bulk tank mounted below the top cover and above the left side panel, the right side panel, and the front panel. The washing machine appliance further includes a dispensing pump in fluid communication with the bulk tank. The dispensing pump is operable to draw a liquid additive from the bulk tank. The washing machine appliance also includes a dispenser box downstream of the dispensing pump and upstream of the wash tub. The dispenser box receives the liquid additive from the bulk tank via the dispensing pump and the liquid additive flows to the wash tub from the dispenser box.

In another exemplary embodiment, a washing machine appliance is provided. The washing machine appliance defines a vertical direction, a lateral direction, and a transverse direction. The vertical, lateral, and transverse directions are mutually perpendicular. The washing machine appliance includes a cabinet extending along the transverse direction from a rear panel to a front panel, along the lateral direction from a left side panel to a right side panel, and along the vertical direction from a bottom end to a top end. A top cover has an opening defined in and through the top cover. The top cover is mounted to the cabinet at the top end of the cabinet. A wash tub is mounted within the cabinet below the top cover and is configured for containing fluid during operation of the washing machine appliance. A wash basket is rotatably mounted within the wash tub such that the wash basket is aligned with and accessible through the opening in the top cover. The washing machine appliance also includes a bulk tank mounted above the cabinet. The washing machine appliance further includes a dispensing pump spaced apart from the bulk tank and in fluid communication with the bulk tank. The dispensing pump is operable to draw a liquid additive from the bulk tank. The washing machine appliance also includes a dispenser box downstream of the dispensing pump and upstream of the wash tub. The dispenser box receives the liquid additive from the bulk tank via the dispensing pump and the liquid additive flows to the wash tub from the dispenser box.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
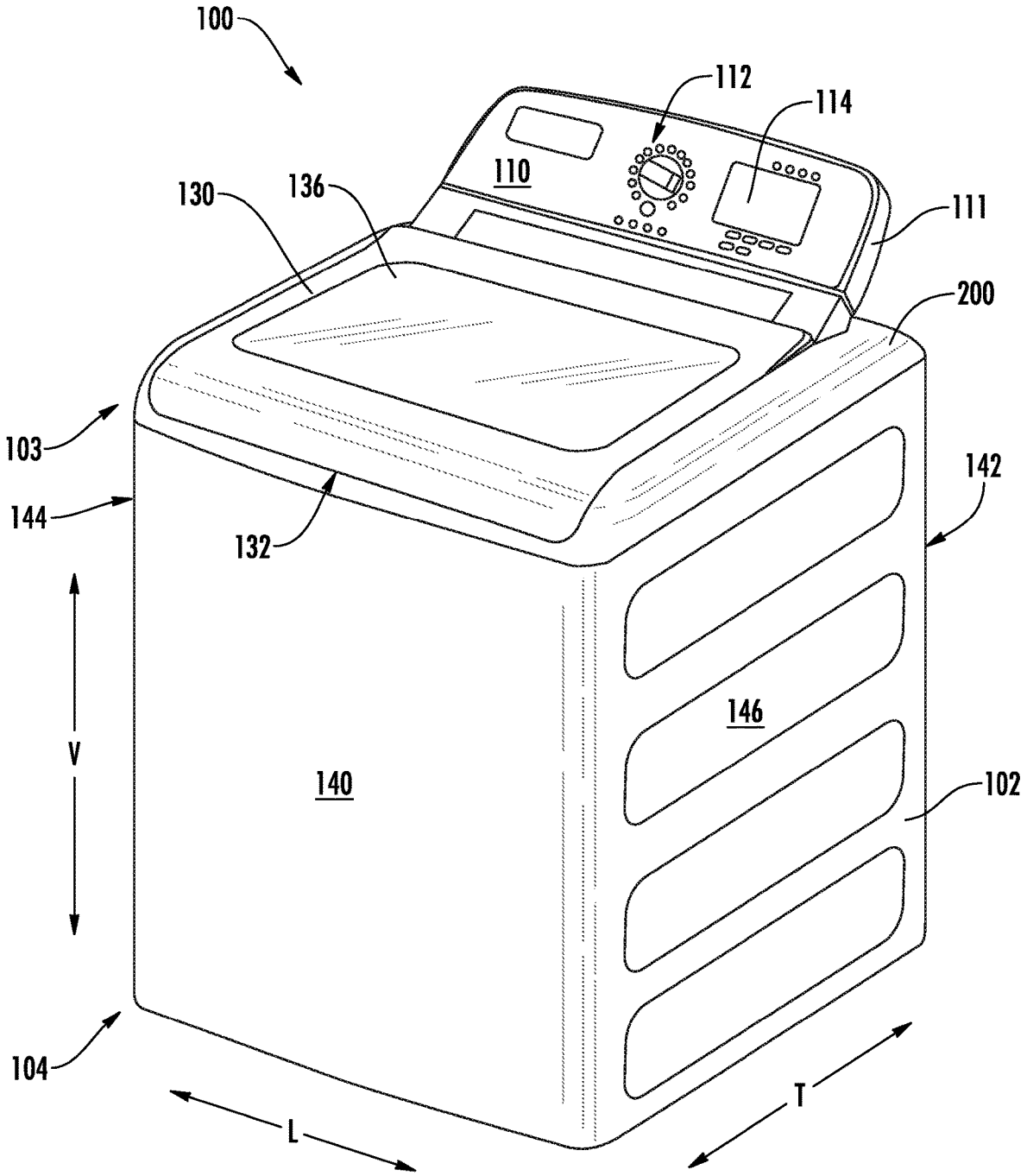
FIG. 1 provides a perspective view of an exemplary washing machine appliance such as may incorporate various embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "clothing" or "clothes" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

Figure 2:
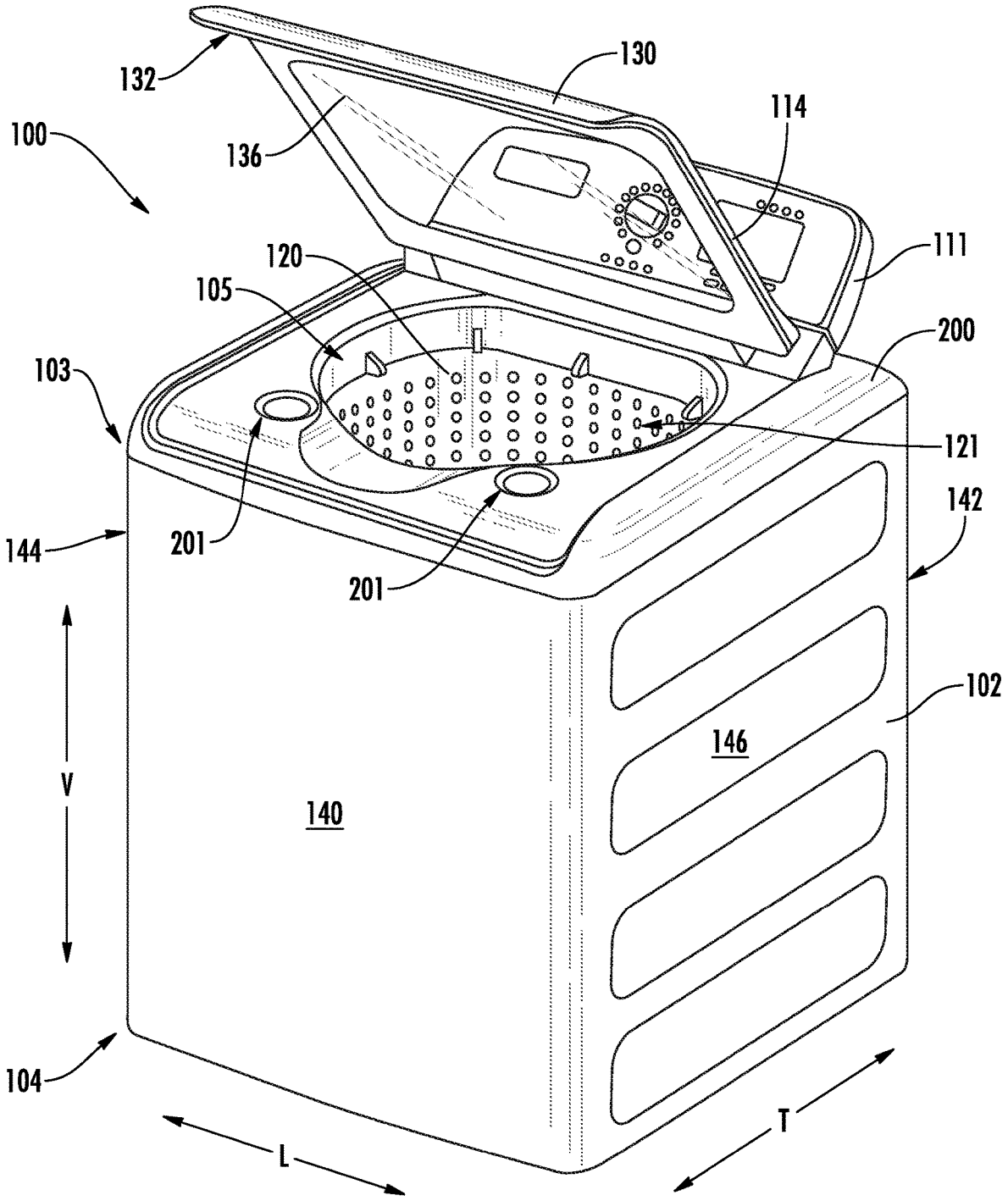
FIG. 2 provides a perspective view of the exemplary washing machine appliance of FIG. 1 with a door of the washing machine appliance shown in an open position.
Figure 3:
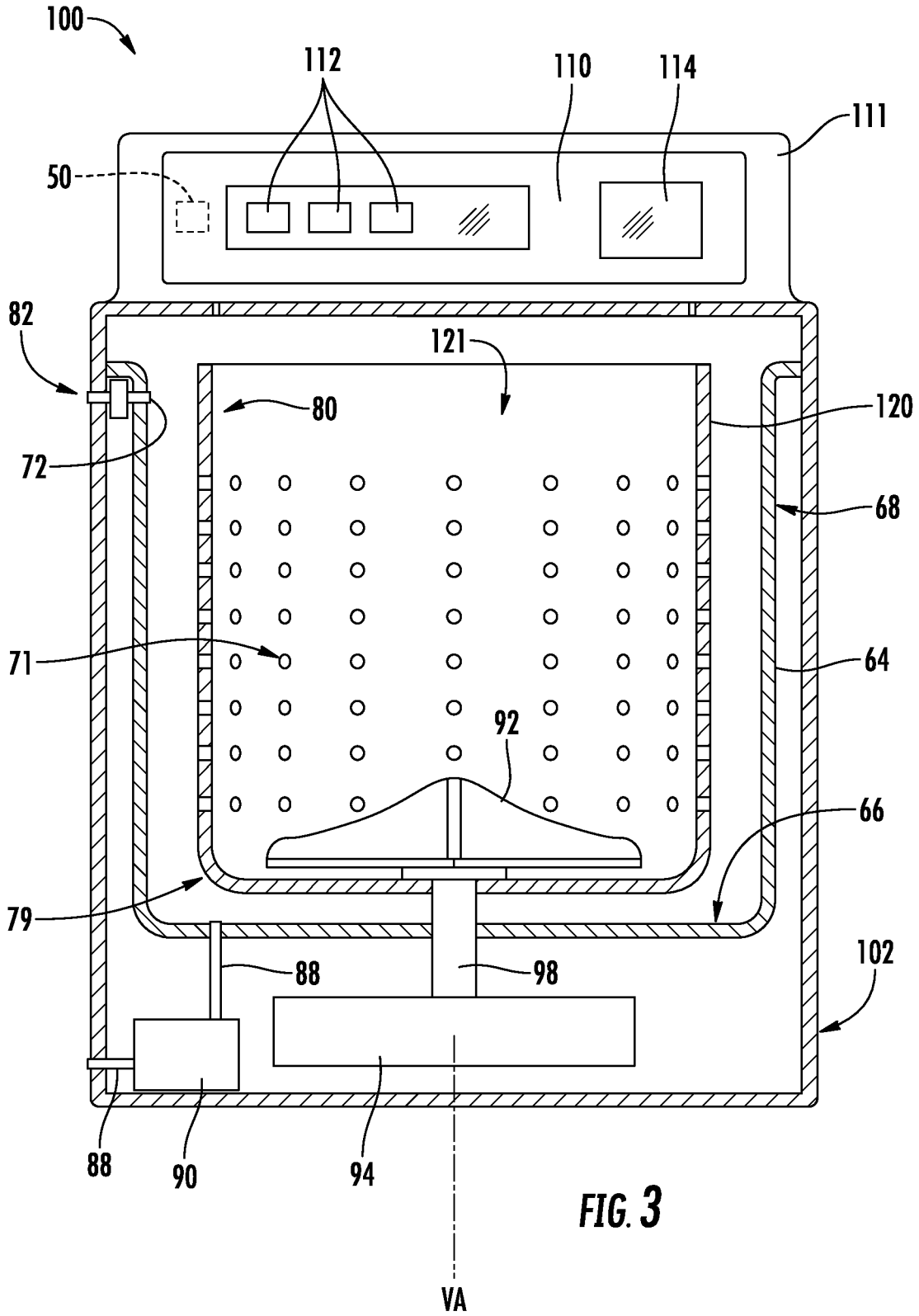
FIG. 3 provides a front, section view of the exemplary washing machine appliance of FIG. 1.

FIGS. 1 through 3 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

As illustrated, washing machine appliance 100 generally defines a vertical direction V, a lateral direction L, and a transverse direction T, each of which is mutually perpendicular, such that an orthogonal coordinate system is generally defined. Washing machine appliance 100 has a cabinet 102 that extends between a top end 103 and a bottom end 104 along the vertical direction V. The cabinet 102 extends along the transverse direction T from a rear panel 142 to a front panel 140 and along the lateral direction L from a left side panel 144 to a right side panel 146. As used herein, terms such as "left" and "right" or "front" and "back" refer to directions from the perspective of a user facing the washing machine appliance 100 for accessing and/or operating the washing machine appliance 100. For example, a user stands in front of the washing machine appliance 100, e.g., at or near the front panel 140, to access door or lid 130 and/or inputs 112 (the door 130 and inputs 112 are described in more detail below).

A wash basket 120 (FIGS. 2 and 3) is rotatably mounted within cabinet 102. A motor 94 (FIG. 3) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller 92 (FIG. 3) extends from wash basket 120 into wash chamber 121. The impeller 92 assists agitation of articles disposed within wash chamber 121 during operation of washing machine appliance 100.

A top cover 200 is mounted on the cabinet 102 of washing machine appliance 100, e.g., the top cover 200 may be mounted to the cabinet 102 at and/or above the top end 103 of the cabinet 102. Top cover 200 defines an opening 105 (FIG. 2) that permits user access to wash chamber 121 of wash basket 120. Door 130 is rotatably mounted to top cover 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top cover 200 defines at least one hole or opening 201 (FIG. 2). The opening 201 is configured for receipt of a fluid additive, e.g., detergent, fabric softener, and/or bleach (usually only one particular additive at a time, although the additive storage and dispensing system described herein may be used with a wide variety of liquid additives). The opening 201 permits the desired liquid additive to pass through top cover 200 to a bulk tank 210 (e.g., FIG. 4) disposed below top cover 200 along the vertical direction V. Two openings 201 are depicted in FIG. 2 by way of example, and embodiments of the present disclosure may include only one opening. In embodiments where only one opening is provided, the one opening may be in either of the locations depicted in FIG. 2.

A control panel 110 with a plurality of input selectors 112 (FIG. 1) is disposed on a backsplash 111 of the washing machine appliance 100 above top cover 200. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device 50 that is operatively coupled to control panel 110 for user manipulation to select washing machine cycles and features. In response to user manipulation of control panel 110, the controller operates the various components of washing machine appliance 100 to execute selected machine cycles and features. The control panel 110 may be positioned on the backsplash 111 of the washing machine appliance 100, e.g., as in the illustrated exemplary embodiments, or may be positioned elsewhere on the washing machine appliance 100, such as on the front panel 140.

FIG. 3 provides a front, cross-section view of washing machine appliance 100. As may be seen in FIG. 3, wash tub 64 includes a bottom wall 66 and a sidewall 68. The wash basket 120 is rotatably mounted within wash tub 64. In particular, wash basket 120 is rotatable about a vertical axis VA. Thus, washing machine appliance is generally referred to as a vertical axis washing machine appliance. Wash basket 120 defines a wash chamber 121 for receipt of articles for washing and extends, e.g., vertically, between a bottom portion 79 and a top portion 80. Wash basket 120 includes a plurality of perforations 71 therein to facilitate fluid communication between an interior of wash basket 120 and wash tub 64.

An inlet 72 is configured for directing a flow of fluid into wash tub 64 and/or wash basket 120, such as directly into the tub 64 or basket 120 and/or via a dispenser box 218. The inlet 72 may be in fluid communication with a water supply (not shown) in order to direct fluid (e.g., clean water) into wash tub 64 and/or onto articles within wash chamber 121 of wash basket 120.

For example, in embodiments which include the dispenser box 218, as will be described in more detail below, the water may flow to the dispenser box 218 from the inlet 72, whereupon the water will mix with an additive in the dispenser box 218, thereby creating a wash liquid comprising the water and the additive dissolved therein or intermixed therewith, and the wash liquid may then flow into the wash chamber 121 from the dispenser box 218 after a certain liquid volume or level within the dispenser box 218 has been reached.

Figure 4:
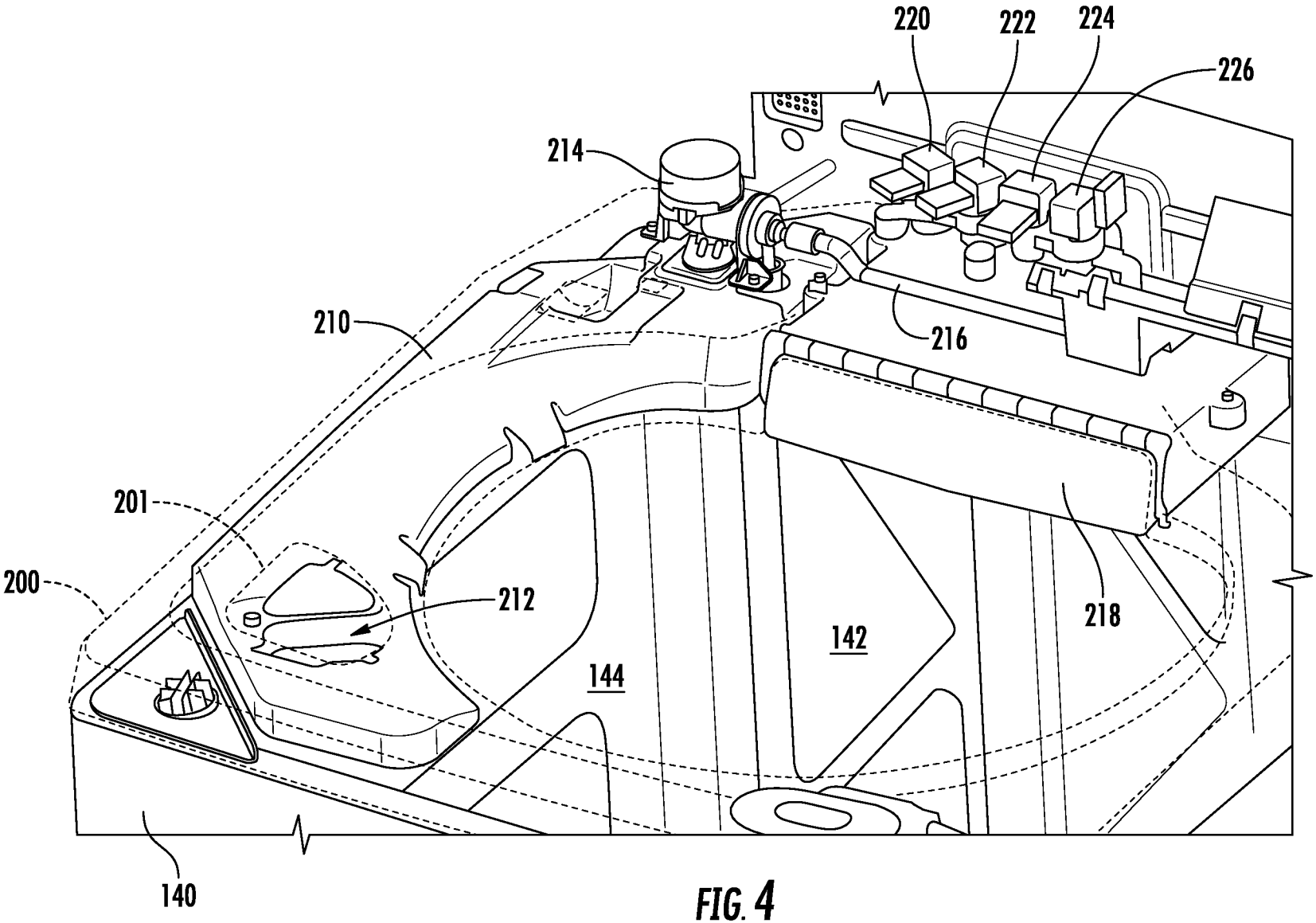
FIG. 4 provides an enlarged perspective view of certain components of the exemplary washing machine appliance of FIG. 1.

The inlet 72 may be coupled to one or more valves, such as a vale manifold comprising valves 220, 222, 224, and 226 (see, e.g., FIG. 4). The valve(s) may direct and/or regulate the flow of fluid through the washing machine appliance. For example, the valve or each valve 220, 222, 224, and/or 226 can selectively adjust to a closed position in order to terminate or obstruct the flow of fluid therethrough. For example, one or more valves may be coupled to a hot water supply, another one or more valves may be coupled to a cold water supply, and each valve may direct the water from the respective water supply to a specific part of the washing machine appliance 100, such as directly into the tub 64 or basket 120, or into the dispenser box 218. For example, warm water may be supplied to the basket 120 by opening (or partially opening) two valves, one coupled to the hot water supply and the other coupled to the cold water supply, so that the water from the supplies intermixes, where both valves are upstream of the basket 120, e.g., directly upstream of the basket 120 without passing through the dispenser box 218. Similarly, water may be provided to the dispenser box 218 at a desired temperature by opening (or partially opening) one or more valves upstream of the dispenser box 218, such as opening a cold water valve to direct cold water to the dispenser box 218, opening a hot water valve to direct hot water to the dispenser box 218, or opening both valves to direct warm water to the dispenser box 218.

A drain pump assembly 90 (shown schematically in FIG. 3) is located beneath tub 64 and wash basket 120 for gravity assisted flow from wash tub 64. Drain pump 90 may be positioned along or in operative communication with a drain line 88 which provides fluid communication from the wash chamber 121 of the basket 120 to an external conduit, such as a wastewater line (not shown). In some embodiments, the pump 90 may also or instead be positioned along or in operative communication with a recirculation line (not shown) which extends back to the tub 64, e.g., in addition to the drain line 88.

An agitation element 92, shown as an impeller in FIG. 3, is disposed in wash basket 120 to impart an oscillatory motion to articles and liquid in wash chamber 121 of wash basket 120. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 3, agitation element 92 is oriented to rotate about vertical axis VA. Wash basket 120 and agitation element 92 are driven by a pancake motor 94. As motor output shaft 98 is rotated, wash basket 120 and agitation element 92 are operated for rotatable movement within wash tub 64, e.g., about vertical axis VA. Washing machine appliance 100 may also include a brake assembly (not shown) selectively applied or released for respectively maintaining wash basket 120 in a stationary position within wash tub 64 or for allowing wash basket 120 to spin within wash tub 64.

Operation of washing machine appliance 100 is controlled by a processing device or controller 50, that is operatively coupled to the user interface inputs 112 located on washing machine backsplash 111 for user manipulation to select washing machine cycles and features. In response to user manipulation of one or more of the user interface inputs 112, controller 50 operates the various components of washing machine appliance 100 to execute selected machine cycles and features.

Controller 50 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 50 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 50 via one or more signal lines or shared communication busses. It should be noted that controllers 50 as disclosed herein are capable of and may be operable to perform any methods and associated method steps as disclosed herein.

Figure 8:
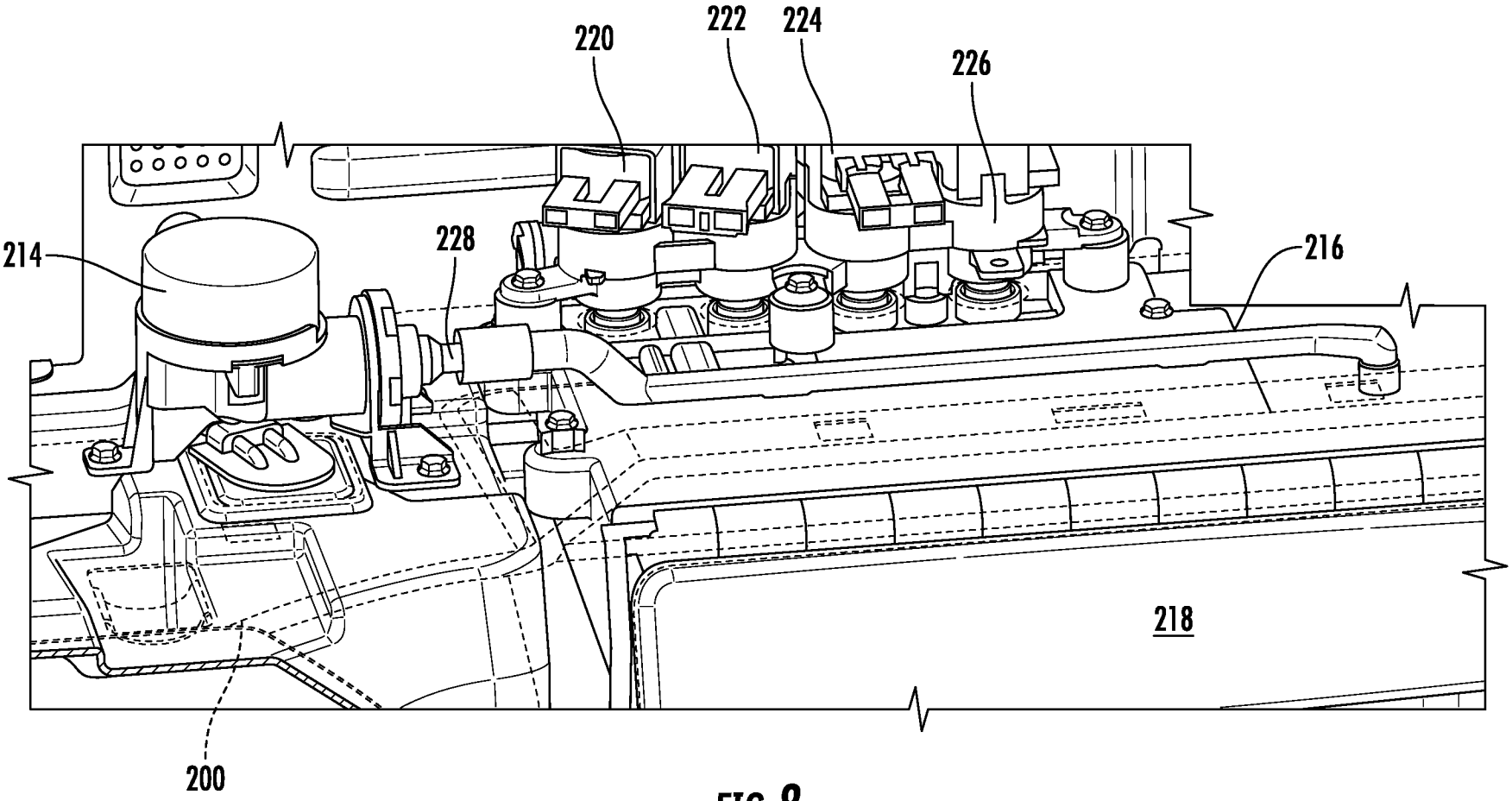
FIG. 8 provides an enlarged perspective view of the exemplary dispensing pump and an exemplary conduit.

In an illustrative embodiment, laundry items may be loaded into wash chamber 121 through opening 105, and washing operation may be initiated through operator manipulation of input selectors 112. Wash basket 120 and/or wash tub 64 may be filled with water and detergent to form a wash fluid. One or more valves (see, e.g., FIGS. 4 and 8) can be controlled by washing machine appliance 100 to provide for filling wash basket 120 and/or wash tub 64 to the appropriate level for the amount of articles being washed. Once wash basket 120 and/or wash tub 64 is properly filled with fluid, the contents of wash chamber 121 are agitated with agitation element 92 for cleansing of laundry items in wash basket 120. More specifically, agitation element 92 may be moved back and forth in an oscillatory motion. The wash fluid may be recirculated through the washing machine appliance 100 at various points in the wash cycle, such as before or during the agitation phase (as well as one or more other portions of the wash cycle, separately or in addition to before and/or during the agitation phase).

After the agitation phase of the wash cycle is completed, wash tub 64 may be drained. Laundry articles can then be rinsed by again adding fluid to wash basket 120, and, depending on the particulars of the cleaning cycle selected by a user, the impeller 92 may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. In various embodiments, the pump 90 may be activated to drain liquid from the washing machine appliance 100 during the entire drain phase (or the entirety of each drain phase, e.g., between the wash and rinse and/or between the rinse and the spin) and may be activated during one or more portions of the spin cycle.

After articles disposed in wash basket 120 are cleaned and/or washed, the user can remove the articles from wash basket 120, e.g., by reaching into wash chamber 121 through opening 105.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may also be utilized with the present subject matter as well.

Exemplary washing machine appliances 100 according to embodiments of the present invention include features for bulk storage and dispensing of fluid additives, e.g., liquid additives. As used herein, the terms "additive" or "fluid additive" generally refer to fluids other than water, such as detergent, bleach, fabric softener, perfumes, and/or other such laundry treatment chemicals.

As mentioned above, the additive handling (e.g., storage and dispensing) system may include a bulk tank 210. The bulk tank 210 may be mounted within the top cover 200 of the washing machine appliance 100, such as below, e.g., underneath, and within the top cover 200, and above the cabinet 102. Thus, top cover 200 is illustrated in dashed lines, e.g., as if the top cover 200 were transparent, in FIGS. 4, 5, and 7 through 10 to more clearly depict the bulk tank 210 and other components of the additive handling system which will be described in more detail below.

The bulk tank 210 may be positioned at the opening 201 of the top cover 200, e.g., an inlet 212 (aperture or opening in the bulk tank 210) of the bulk tank 210 may be aligned with and positioned below the opening 201. As an example, a user can pour an additive such as detergent through the opening 201 such that the additive passes into bulk tank 210 (e.g., into an internal volume therein) via the opening 201 in the top cover 200 and the inlet 212 in the bulk tank 210. Bulk tank 210 may be constructed of any suitable material. For example, bulk tank 210 may be constructed of a plastic, a metal, or a combination of materials. As illustrated in, e.g., FIG. 4, the bulk tank 210 may be mounted below the top cover 200 and above the left side panel 144, the right side panel 146, the rear panel 142, and the front panel 140 of the cabinet 102.

The washing machine appliance 100 may also include a dispensing pump 214 in fluid communication with the bulk tank 210, e.g., the dispensing pump 214 may be coupled to the bulk tank 210 such that the dispensing pump 214 is configured to and operable to draw a liquid additive from the bulk tank 210. In some embodiments, the dispensing pump 214 may be spaced apart from the bulk tank 210, e.g., the dispensing pump 214 may be positioned entirely outside the bulk tank 210. Such embodiments advantageously provide increased additive storage volume inside the bulk tank 210, e.g., as compared to systems where the pump is at least partially disposed in the bulk tank or the bulk tank otherwise has to carve out space for the pump.

Figure 5:
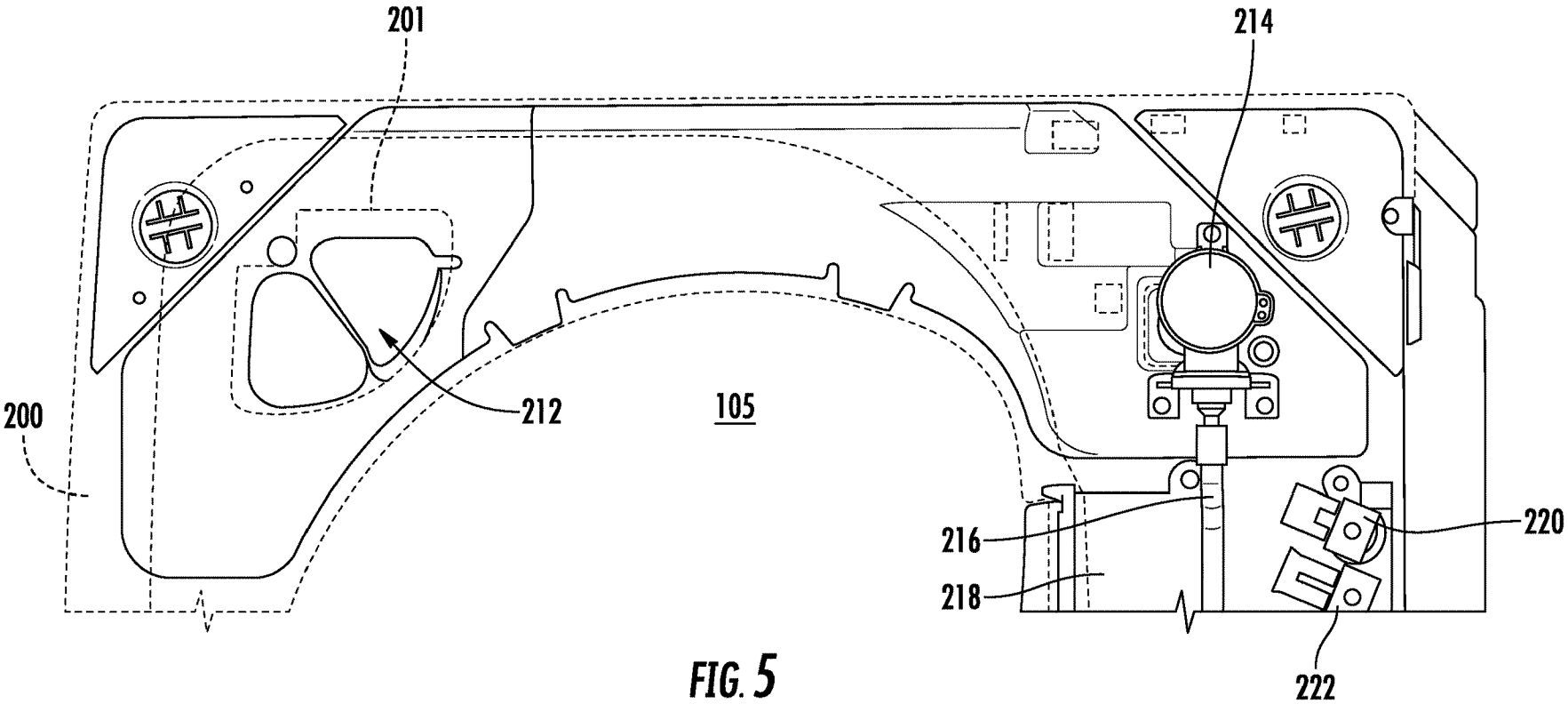
FIG. 5 provides a top view of certain components of the exemplary washing machine appliance of FIG. 1.
Figure 10:
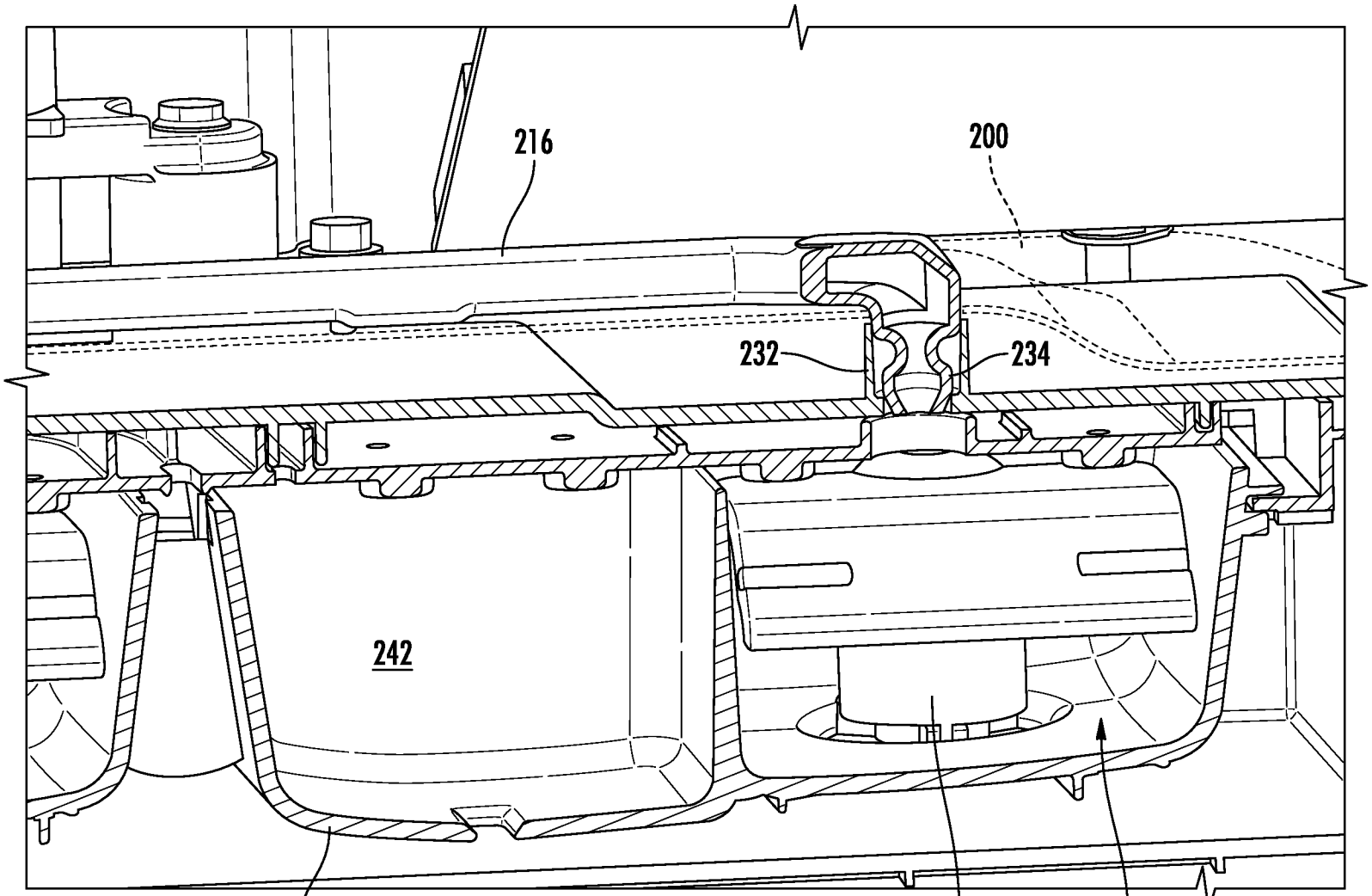
FIG. 10 provides an enlarged, partially sectioned perspective view of portions of the exemplary conduit of FIG. 8 and an exemplary dispenser box.

The washing machine appliance 100 may further include a dispenser box 218. In some embodiments, e.g., as illustrated in FIGS. 4 and 5, the dispenser box 218 may include a dispenser drawer slidably received therein. The dispenser box 218 may be downstream of the water inlet 72 (FIG. 3) of the washing machine appliance 100, e.g., that is connected to a household water supply or plumbing system or other source of water. Thus, the dispenser box 218 may receive a flow of water from the water source via the water inlet 72 of the washing machine appliance 100. The dispenser box 218 may further be downstream of the dispensing pump 214, such that the dispenser box 218 also receives a flow of additive from the bulk tank 210 when the dispensing pump 214 is activated such that the dispensing pump 214 thereby motivates the additive from the bulk tank 210 to the dispenser box 218. The water and additive may then mix in the dispenser box 218. For example, the dispenser box 218 may include compartment or chambers therein which receive each flow, e.g., as illustrated in FIG. 10, an additive chamber 244 and a water chamber 242, where each liquid is contained within the dispenser box 218 separately from the other liquid until a predetermined level of one of the liquids, e.g., the water, is reached, such that the one liquid, e.g., water, overflows its compartment and mixes with the other liquid. For example, the water may, once a predetermined volume of water based on the size of the water chamber 242 in the dispenser box 218 is reached, overflow the water chamber 242, then enter into and flush out the additive chamber 244 of the dispenser box 218, whereupon the water and additive mix in the dispenser box 218 to form a wash liquid or wash liquor. Further, the dispenser box 218 may be upstream of the wash tub 64 and/or the wash basket 120 and chamber 121, such that the wash liquid formed in the dispenser box 218 as described is then directed to the wash tub 64 and/or basket 120 from the dispenser box 218.

Figure 9:
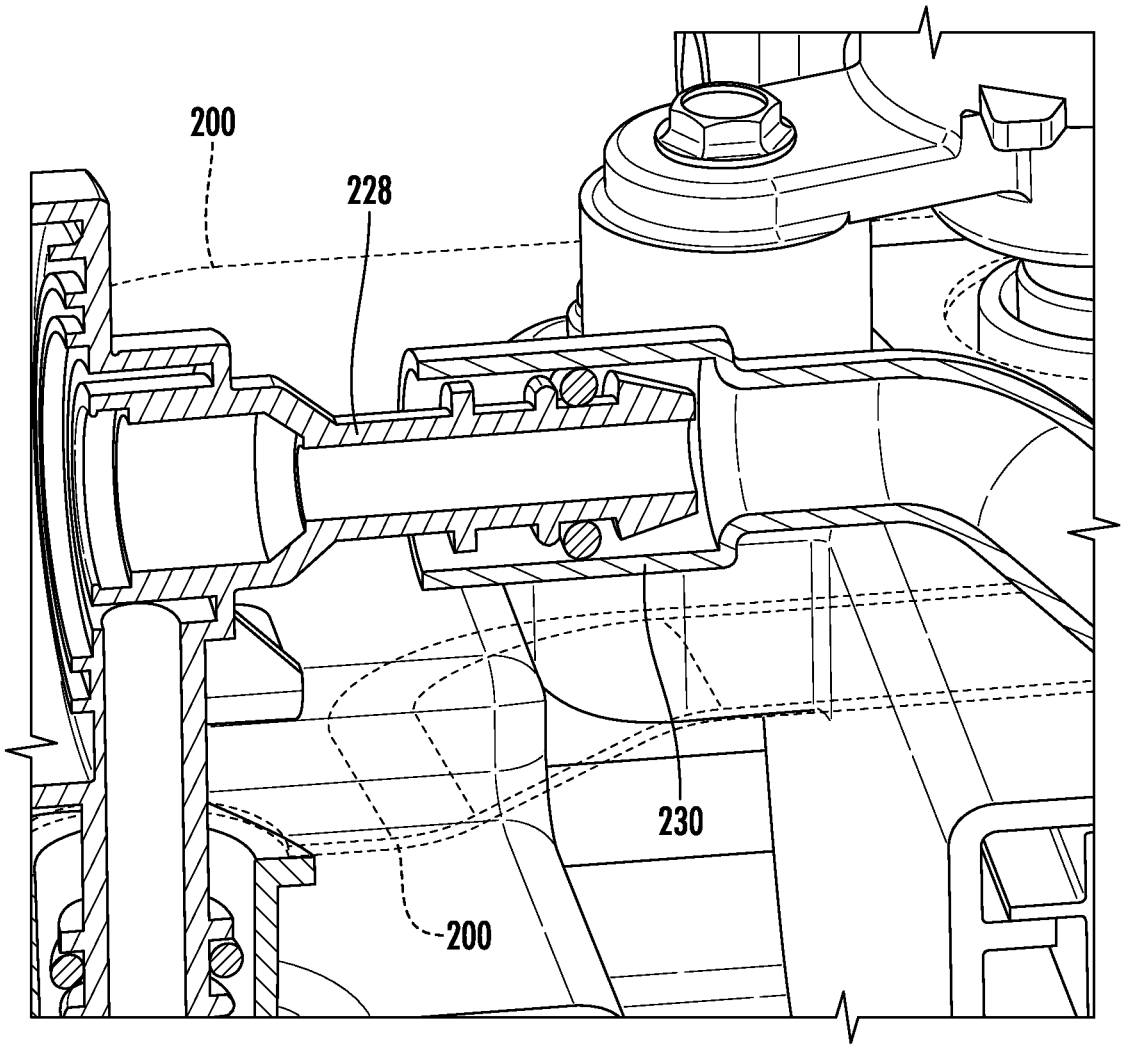
FIG. 9 provides an enlarged, partially sectioned perspective view of portions of the exemplary dispensing pump and the exemplary conduit.

As may be seen, e.g., in FIG. 4 and FIGS. 8 through 10, the dispensing pump 214 may be connected to the dispenser box 218 by a conduit 216. The conduit 216 may extend from the dispensing pump 214 to the dispenser box 218. For example, the conduit 216 may be coupled to an outlet 228 of the dispensing pump 214 at an inlet 230 of the conduit 216 and coupled to an inlet 232 of the dispenser box 218 at an outlet 234 of the conduit 216. In some embodiments, e.g., as illustrated in FIG. 9, the inlet 230 of the conduit 216 may be press fit to the outlet 228 of the dispensing pump 214. Also, in some embodiments, e.g., as illustrated in FIG. 10, the outlet 234 of the conduit 216 may be press fit to the inlet 232 of the dispenser box 218. As may be seen, e.g., in FIG. 10, the inlet 232 of the dispenser box 218 may be defined directly above the additive chamber 244, such that additive urged into and through the conduit 216 by the dispensing pump 214 flows directly into the additive chamber 244, e.g., without entering or passing through the water chamber 242.

Figure 6:
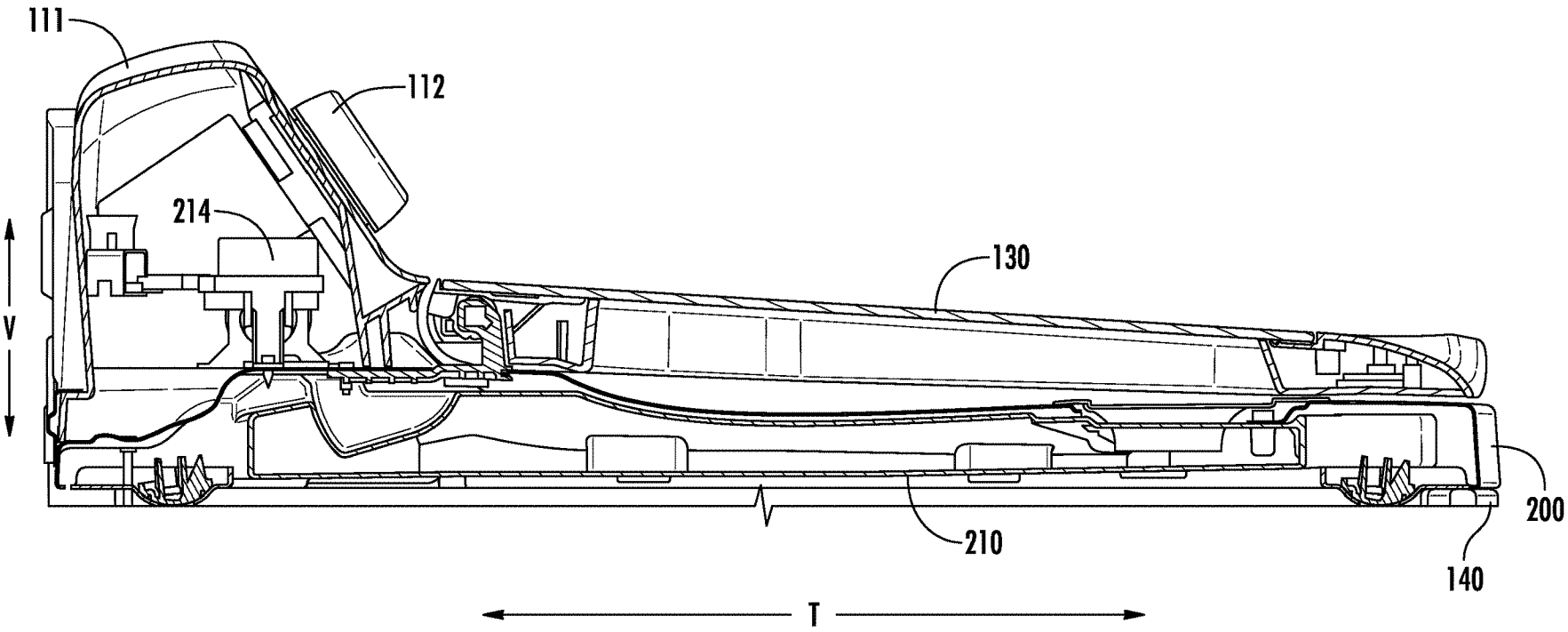
FIG. 6 provides a side, section view of certain components of the exemplary washing machine appliance of FIG. 1.
Figure 7:
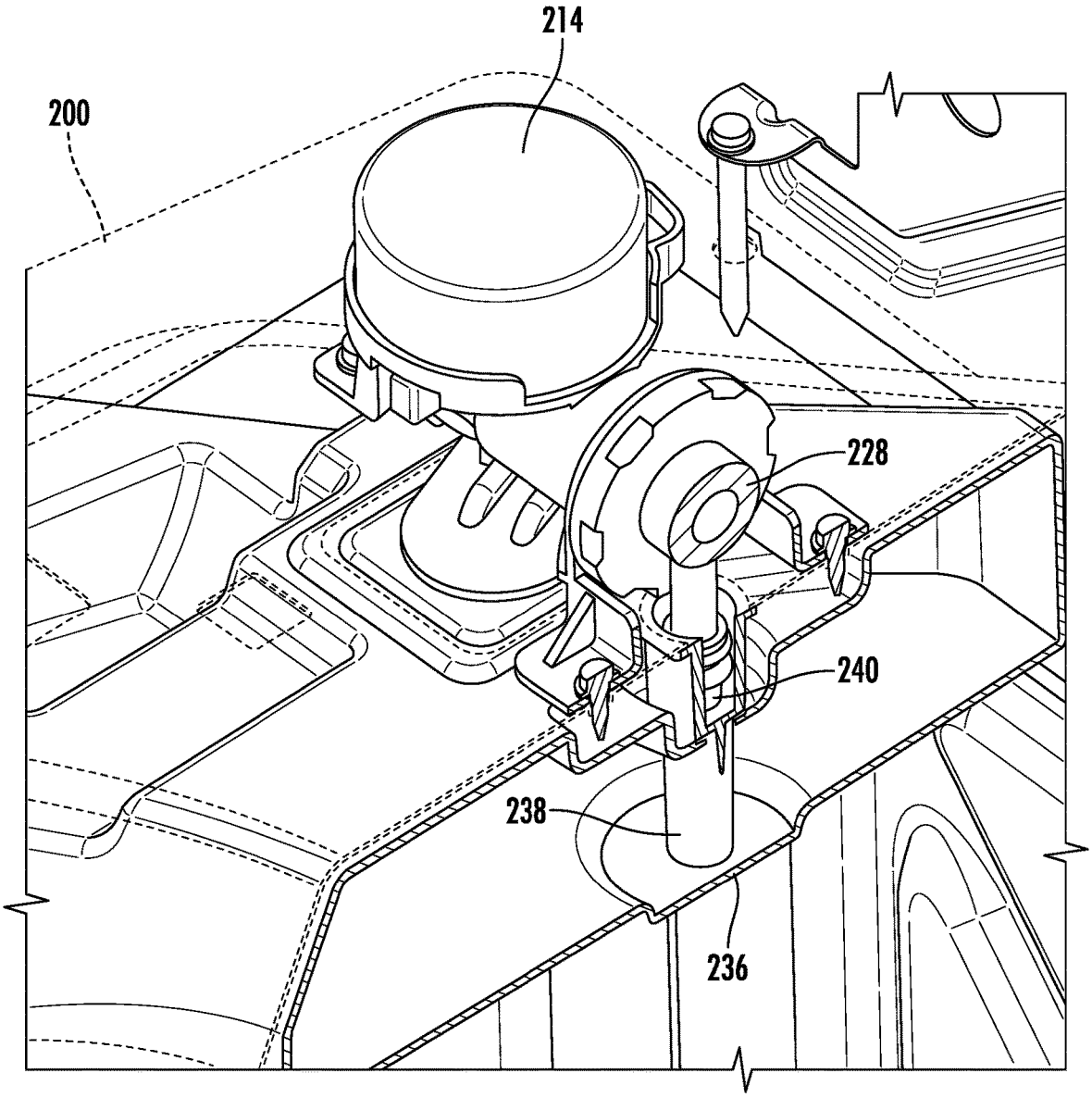
FIG. 7 provides an enlarged, partially sectioned perspective view of an exemplary bulk tank and an exemplary dispensing pump of the exemplary washing machine appliance of FIG. 1.

As illustrated in FIG. 7, in some embodiments the bulk tank 210 may include a sump 236 defined at the lowest point in the bulk tank 210. In such embodiments, liquid additive stored in the bulk tank 210 flows to the sump 236 by gravity. The sump 236 may be positioned in a back portion of the bulk tank 210 along the transverse direction T and may extend below the remainder of the bulk tank 210 along the vertical direction V. Further, as may be seen in FIG. 6, the bulk tank 210 may slope towards the back of the washing machine appliance 100, e.g., along the transverse direction T, and thus towards the sump 236 of the bulk tank 210, in order to promote the gravity flow of liquid additive within the bulk tank 210 to the sump 236. Returning again to FIG. 7, the washing machine appliance 100 may further include an intake tube 238 extending from the sump 236 to an inlet 240 of the dispensing pump 214. In some embodiments, e.g., as illustrated in FIG. 7, the intake tube 238 may extend generally along the vertical direction V. Also as illustrated for example in FIG. 7, the dispensing pump 214 may be positioned directly above the sump 236 of the bulk tank 210. In particular, the dispensing pump 214 may be mounted above the bulk tank 210, e.g., atop the top cover 200 and within the backsplash 111 of the washing machine appliance 100, as may be seen in FIG. 6. In particular, as may be seen, e.g., in FIGS. 4, 6, 7, and 8, the dispensing pump 214 does not intrude into or extend into the internal volume of the bulk tank 210. For example, the portion of the bulk tank 210 directly below the dispensing pump 214 along the vertical direction V is flat and does not include any carve out, e.g., indentation, concave portion, etc., to accommodate the location of the dispensing pump 214, other than where the inlet 240 connects to the intake tube 238 (e.g., as seen in FIG. 7).

Figure 11:
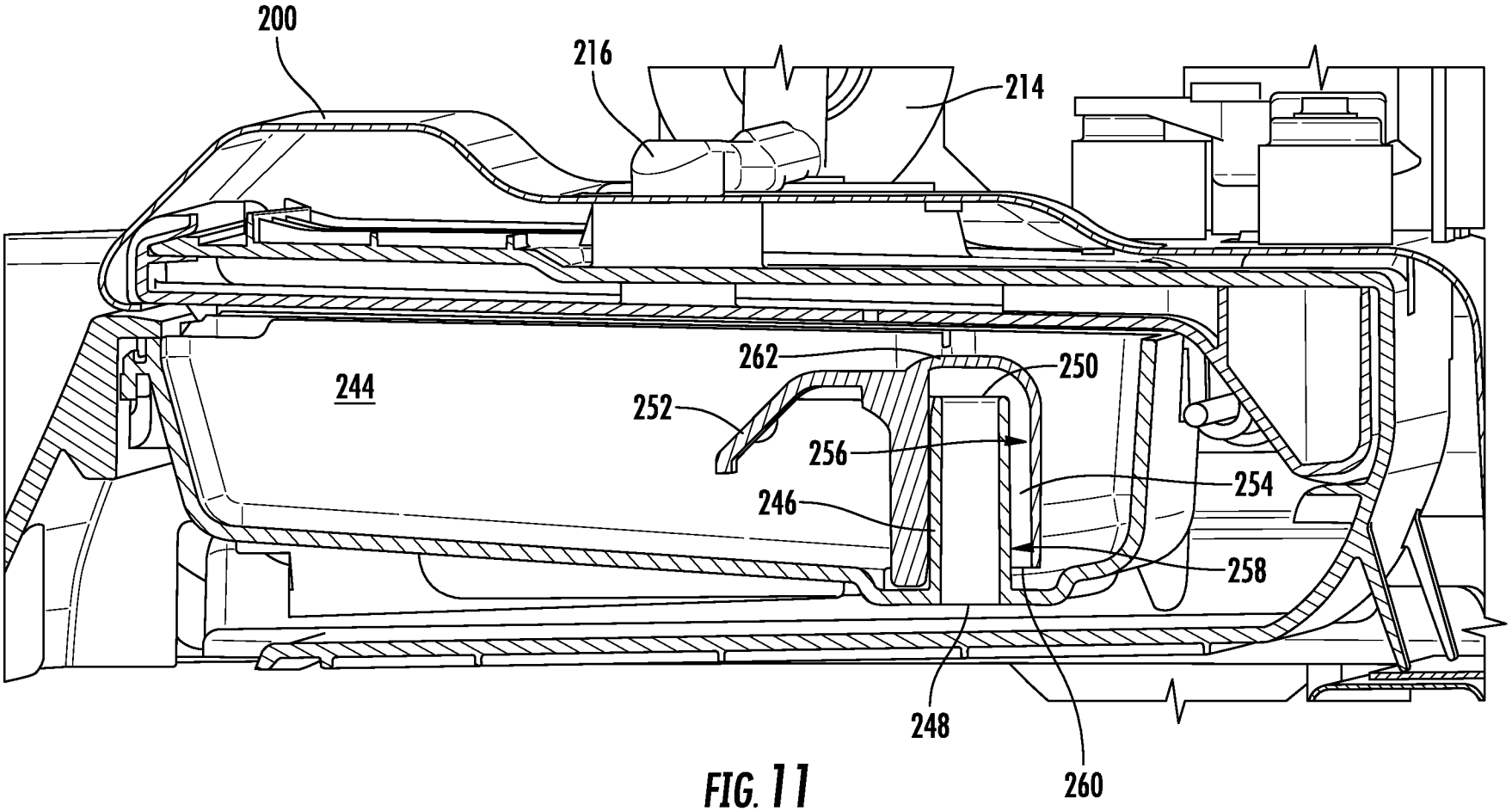
FIG. 11 provides another section view of the exemplary dispenser box.

Turning now to FIG. 11, dispenser box 218 further includes a siphon tube 246, wherein the siphon tube 246 defines an outlet 248 from the dispenser box 218 into the wash tub 64, such as into the wash basket 120 therein. As may be seen in FIG. 11, the siphon tube 246 extends from a siphon tube inlet 250 to the outlet 248. A siphon cap 252 may be provided over and around, e.g., surrounding, the siphon tube 246 such that a siphon passage 254 is defined between an inner surface 256 of the siphon cap 252 and an outer surface 258 of the siphon tube 246 for siphoning liquid from the dispenser box 218 to the siphon tube inlet 250.

The siphon cap 252 may be positioned above and around the siphon tube 246 such that an inlet 260 of the siphon cap 252 is positioned below the siphon tube inlet 250 along the vertical direction V and a top wall 262 of the siphon cap 252 is positioned above the siphon tube inlet 250 along the vertical direction V. In this arrangement, siphon cap 252 and siphon tube 246 are juxtaposed along the vertical direction V such that they are partially overlapped vertically, and a narrow gap remains therebetween, e.g., defining the siphon passage 254 between the inner surface 256 of the siphon cap 252 and the outer surface 258 of the siphon tube 246 for siphoning liquid out of the additive chamber 244 from the inlet 260 of the siphon cap 252 to the inlet 250 of the siphon tube 246. In some exemplary embodiments, siphon tube 246 and siphon cap 252 may be cylindrical and collectively define a longitudinal direction, a radial direction perpendicular to the longitudinal direction, and a circumferential direction that extends around a longitudinal axis of the cylindrical siphon tube 246 and siphon cap 252. In such embodiments, the width of the siphon passage 254 defined between the inner surface 2256 of the siphon cap 252 and the outer surface 258 of the siphon tube 246 may lie along the radial direction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the vertical, lateral, and transverse directions are mutually perpendicular, the washing machine appliance comprising:

a cabinet extending along the transverse direction from a rear panel to a front panel, along the lateral direction from a left side panel to a right side panel, and along the vertical direction from a bottom end to a top end;

a top cover having an opening defined in and through the top cover mounted to the cabinet at the top end of the cabinet;

a wash tub mounted within the cabinet below the top cover and configured for containing fluid during operation of the washing machine appliance;

a wash basket rotatably mounted within the wash tub, whereby the wash basket is aligned with and accessible through the opening in the top cover;

a bulk tank mounted below the top cover and above the left side panel, the right side panel, and the front panel, the bulk tank comprising a sump defined at a lowest point in the bulk tank whereby liquid additive stored in the bulk tank flows to the sump by gravity;

a dispensing pump positioned entirely outside the bulk tank and directly above the sump, the dispensing pump in fluid communication with the bulk tank, the dispensing pump operable to draw a liquid additive from the bulk tank;

an intake tube extending from the sump to an inlet of the dispensing pump; and a dispenser box downstream of the dispensing pump and upstream of the wash tub, wherein the dispenser box receives the liquid additive from the bulk tank via the dispensing pump and the liquid additive flows to the wash tub from the dispenser box.

2. The washing machine appliance of claim 1, further comprising a conduit extending from the dispensing pump to the dispenser box, the conduit coupled to an outlet of the dispensing pump at an inlet of the conduit and coupled to an inlet of the dispenser box at an outlet of the conduit, wherein the inlet of the conduit is press fit to the outlet of the dispensing pump and the outlet of the conduit is press fit to the inlet of the dispenser box.

3. The washing machine appliance of claim 1, wherein the intake tube extends generally along the vertical direction.

4. The washing machine appliance of claim 1, wherein the dispensing pump is mounted above the bulk tank within a backsplash of the washing machine appliance.

5. The washing machine appliance of claim 4, wherein the dispensing pump is mounted atop the top cover.

6. The washing machine appliance of claim 1, further comprising a conduit extending from the dispensing pump to the dispenser box, the conduit coupled to an outlet of the dispensing pump at an inlet of the conduit and coupled to an inlet of the dispenser box at an outlet of the conduit, wherein the dispenser box comprises an additive chamber and a water chamber, and wherein the inlet of the dispenser box is defined directly above the additive chamber.

7. The washing machine appliance of claim 6, wherein the dispenser box further comprises a siphon tube, wherein the siphon tube defines an outlet from the dispenser box into the wash tub, the siphon tube extending from a siphon tube inlet positioned in the additive chamber of the dispenser box to the outlet.

8. A washing machine appliance defining a vertical direction, a lateral direction, and a transverse direction, the vertical, lateral, and transverse directions are mutually perpendicular, the washing machine appliance comprising:

a cabinet extending along the transverse direction from a rear panel to a front panel, along the lateral direction from a left side panel to a right side panel, and along the vertical direction from a bottom end to a top end;

a top cover having an opening defined in and through the top cover mounted to the cabinet at the top end of the cabinet;

a wash tub mounted within the cabinet below the top cover and configured for containing fluid during operation of the washing machine appliance;

a wash basket rotatably mounted within the wash tub, whereby the wash basket is aligned with and accessible through the opening in the top cover;

a bulk tank mounted above the cabinet, the bulk tank comprising a sump defined at a lowest point in the bulk tank whereby liquid additive stored in the bulk tank flows to the sump by gravity;

a dispensing pump spaced apart from the bulk tank and positioned directly above the sump, the dispensing pump in fluid communication with the bulk tank, the dispensing pump operable to draw a liquid additive from the bulk tank;

an intake tube extending from the sump to an inlet of the dispensing pump; and a dispenser box downstream of the dispensing pump and upstream of the wash tub, the dispenser box comprising an additive chamber and a water chamber, wherein the dispenser box receives the liquid additive into the additive chamber from the bulk tank via the dispensing pump and the liquid additive flows to the wash tub from the additive chamber of the dispenser box.

9. The washing machine appliance of claim 8, wherein the bulk tank is mounted below the top cover and above the left side panel, the right side panel, and the front panel.

10. The washing machine appliance of claim 8, further comprising a conduit extending from the dispensing pump to the dispenser box, the conduit coupled to an outlet of the dispensing pump at an inlet of the conduit and coupled to an inlet of the dispenser box at an outlet of the conduit, wherein the inlet of the conduit is press fit to the outlet of the dispensing pump and the outlet of the conduit is press fit to the inlet of the dispenser box.

11. The washing machine appliance of claim 8, wherein the intake tube extends generally along the vertical direction.

12. The washing machine appliance of claim 8, wherein the dispensing pump is mounted above the bulk tank within a backsplash of the washing machine appliance.

13. The washing machine appliance of claim 12, wherein the dispensing pump is mounted atop the top cover.

14. The washing machine appliance of claim 8, wherein the dispenser box further comprises a siphon tube, wherein the siphon tube defines an outlet from the dispenser box into the wash tub, the siphon tube extending from a siphon tube inlet positioned in the additive chamber of the dispenser box to the outlet.

15. The washing machine appliance of claim 14, further comprising a conduit extending from the dispensing pump to the dispenser box, the conduit coupled to an outlet of the dispensing pump at an inlet of the conduit and coupled to an inlet of the dispenser box at an outlet of the conduit, wherein the inlet of the dispenser box is defined directly above the additive chamber.

* * * * *